United States Patent [19]

Eichenauer

[11] 4,082,215

[45] Apr. 4, 1978

[54] CARTON FOR FRUIT AND THE LIKE

[76] Inventor: Larry L. Eichenauer, 16210 Spinnaker Dr., Crosby, Tex. 77532

[21] Appl. No.: 757,752

[22] Filed: Jan. 7, 1977

[51] Int. Cl.[2] ..... B65D 5/30

[52] U.S. Cl. ..... 229/36; 229/33

[58] Field of Search ..... 229/33, 36, 34, 35

[56] References Cited

U.S. PATENT DOCUMENTS

| | | | |
|---|---|---|---|
| 1,862,980 | 6/1932 | Prather et al. | 229/33 UX |
| 1,894,226 | 1/1933 | Ross | 229/36 |
| 2,162,169 | 6/1939 | Grossman | 229/36 |
| 2,323,782 | 7/1943 | Kretchmer | 229/36 |
| 2,858,058 | 10/1958 | Kitchell | 229/33 |
| 3,207,414 | 9/1965 | Locke et al. | 229/36 |
| 3,291,367 | 12/1966 | Carter | 229/33 |

FOREIGN PATENT DOCUMENTS

| | | | |
|---|---|---|---|
| 979,878 | 1/1965 | United Kingdom | 229/33 |
| 1,439,600 | 6/1976 | United Kingdom | 229/33 |

*Primary Examiner*—Davis T. Moorhead
*Attorney, Agent, or Firm*—Donald Gunn

[57] ABSTRACT

An improved carton construction is disclosed. In the illustrated embodiment, it utilizes a top closure which folds over the top of the assembled carton, therebeing a matching closure on the opposite side to define a central opening for ventilating the fruit. Each top closure has appended at each end a curved skirt which terminates in a protruding tab. The tab inserts into a half circle opening, commonly called a half-thumb hole which is cut with an L-shaped cut, thereby securing the pair of top closures above a multiple thickness shoulder which gives strength to the end wall of the box for stacking.

3 Claims, 2 Drawing Figures

CARTON FOR FRUIT AND THE LIKE

PRIOR ART

U.S. Pat. No. 268,311; Stewart
U.S. Pat. No. 306,532; Schmidt
U.S. Pat. No. 1,894,226; Ross
U.S. Pat. No. 2,162,169; Grossman
U.S. Pat. No. 2,309,134; Morgan
U.S. Pat. No. 2,648,484; Belsinger
U.S. Pat. No. 2,741,415; Meitzen
U.S. Pat. No. 3,291,367; Carter
U.S. Pat. No. 633,782; Bext
U.S. Pat. No. 638,776; Williams
U.S. Pat. No. 2,323,782; Kretchmer

BACKGROUND OF THE PROBLEM

The prior art represents efforts of the past to construct and devise a suitable crate for transportation of perishable fruits, vegetables and the like. This invention is particularly adapted for shipment of fruits, vegatables, etc. which can be bruised or otherwise damaged if packed in large containers. For instance, many items such as potatoes can be handled in bushel quantities or greater. Other produce is more delicate and must be packed in smaller containers. An example is peaches or tomatoes. The present invention is a box which enables more delicate fruit to be packed. Contrasted with the delicate nature of the fruit itself, the box must be quite rugged. The box must permit stacking to a substantial height. In this regard, the present invention is a carton which is formed of flat sheet, multi-layered, corrugated cardboard. The flat sheet is cut on the profile, is additionally die cut to form certain cuts, openings or the like in it and is scored along certain lines. It is additionally creased. The creases differ from scoring in that the scoring punctures partly through the cardboard while the crease is formed without puncturing through it.

This, therefore, results in the construction of a box which will be easily folded or assembled at the time that it is required and thereby enables the user to quickly assemble the box in a matter of a few seconds. The box cannot be fully assembled until it is filled with the produce. After it has been filled, it is closed over and the improved tabs of the present invention are locked in place. There is little likelihood that the tabs will jiggle free of the openings where they are inserted. Indeed, they provide a very rugged and substantial closed box.

SUMMARY OF THE PRESENT INVENTION

This invention is summarized briefly as a sheet of multi-layered, corrugated cardboard formed of blank stock in a single plane which is shaped into a carton. It is shaped by cutting around the perimeter, and additionally forming other cuts. Certain perforations are formed in it. In addition, it is creased and scored as is appropriate. The shape of the box is particularly enhanced by the incorporation of a multiple thickness on the end wall, defining an upwardly facing top shoulder. The shoulder is adapted to receive the end of a top covering closure. The closure itself terminates at both ends in a skirt which is curved and supports a protruding lock tab. The lock tab is able to be inserted into a specifically located hole. The hole itself is a half thumb hole adjacent to an L-shaped cut to define a pocket where the lock tab is inserted, thereby securing the top closure. The box is symmetrically constructed along its center line.

DETAILED DESCRIPTION OF THE PREFERRED EMBODIMENT

Figure 1:
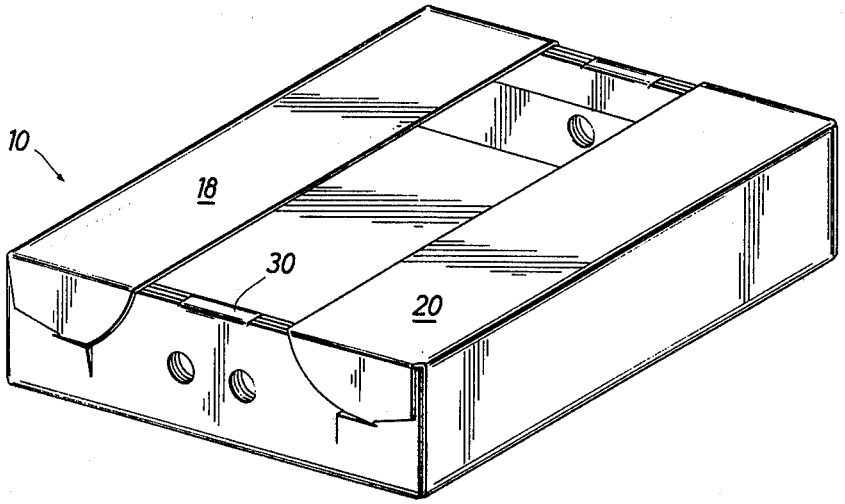
FIG. 1 is a perspective view of the present invention showing the assembled box and, in particular, showing how the top flap folds over the end shoulder to position a lock tab adjacent to a hole where it is inserted.
Figure 2:
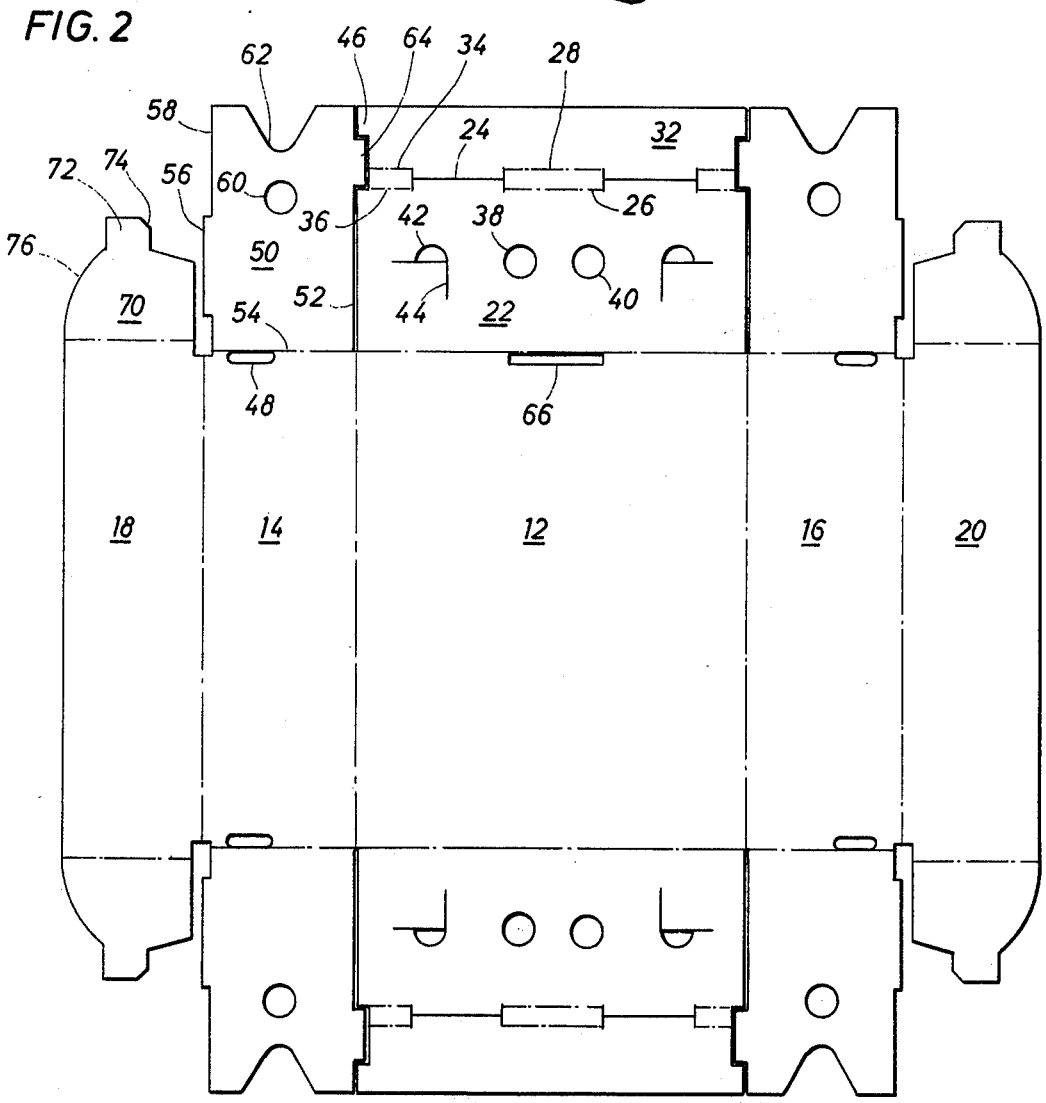
FIG. 2 is a plan view of the blank cardboard member in a single plane showing its shape, various cuts and profiles prior to assembly.

Attention is first directed to FIG. 1 of the drawings where the numeral 10 identifies the box of the present invention. It is shown in the assembled state. Before its assembly is described, the various portions of the box will be described in detail. This description is obtained on review of FIG. 2 where the box material is shown in planar fashion. In FIG. 2 of the drawings, the description begins by first specifying the material. The box of the present invention is preferably formed of multi-layered, smooth faced, corrugated cardboard. The thickness or weight of cardboard is not critical; it is important to have adequate strength for the weight to be carried in the box and to this end, the preferred material is the multi-layered, corrugated cardboard mentioned above. It is shaped in the manner shown in FIG. 2 by conventional manufacturing apparatus which cuts the planar cardboard to a given profile, punches holes therein as required, creases and scores the box to complete the blank box shown in FIG. 2.

In FIG. 2, numeral 12 identifies the bottom of the box. One side wall is identified by the numeral 14 while the opposite side wall is 16. These attach along the long dimensions of the box. The side wall 14 is adjacent to a top closure 18 while a symmetrical and duplicate closure 20 is shown on the opposite side. It will be observed that the components 12, 14, 16, 18 and 20 are separated by creases which are formed in the box. The creases define fold lines. Thus, the bottom 12 is laid horizontal while the sides 14 and 16 are vertical extending thereabove and the closures 18 and 20 close over the top as depicted better in FIG. 1.

Since the device of the present invention is symmetrical along a center line, it is necessary to describe only one side of the equipment, the remainder of the box being a mirror image of the described side. To this end, the description will focus on the left side, it being understood that the right side is constructed in like fashion. Going now to the left side, the vertical wall 14, when erected, abuts an end wall which is partly formed out of a flap 22. The end flap stands taller than the side wall 14. It incorporates a cut line at 24 which extends to a set of score marks 26 and 28. The score marks 26 and 28 are parallel to one another. Because they are parallel, they define a webbing portion 30 (in FIG. 1) which prevents separation of the components when they are folded 180°. The score line 28 defines a separable portion 32. The portion 32 is folded 180° along the score line 24. This defines the webbing 30 and hence the shoulder which is found at the top edge of the end of the box. The cut line 24 will be observed to extend only partly across the blank material. More precisely, the cut line 24 is teed at each end where additional score marks are shown at 34 and 36. These extend to the edge of the end flap 22. It will be observed that the flap portion 32 folds over to reinforce the end flap 22. It is not as tall as the end flap 22. It is shorter, although it can be made as tall as the end flap 22 to thereby completely double the thickness of material in the end of the box. Thus, the flap 32 is folded to the inside of the box. The flap 22 defines the exposed end of the box. The flap 22 is perforated with vent holes 38 and 40. Together, they provide large openings where a user can insert his fingers to lift the box.

A half thumb hole 42 is formed. The end flap is additionally cut with an L-shaped cut at 44. The cut 44, in conjunction with the thumb hole 42, is a recepticle for inserting a lock tab to be described. It will be noted that the thumb hole 42 is near the edge of the flap 22. It is located in a portion of the flap 22 which is otherwise unperforated to enable the flap to bend only slightly when the lock tab is inserted through the thumb hole 42 at the L-shaped cut 44. The length of the cut 44 is controlled so that the end flap does not deflect out by an unwanted distance and thereby lose its grip on the lock tab.

The end 22 thus presents a substantially rectangular construction when the box is erected. Suitable holes 38 and 40 enable a user to lift the box quite readily. The end flap 22, moreover, has a means for receiving and holding a lock tab. The end flap 22 incorporates a protruding tab portion 46 which locks into an oval shaped appropriately sized slot 48 in the side wall 14. When the box is assembled, the tab 46 extends into the slot 48 to lock the two together. This is achieved by first folding the flap 32 over at the line 24. It is folded over toward the inside of the box. The end flap 22 is folded to an erect position, and the same is done for the side wall 14. The two are brought together, thereby positioning the tab 46 in the opening 48.

The side wall 14 includes an appended tab 50 which is separated from the end 22 by a cut at 52. A crease is defined at 54. The crease is in the form of a machine formed imprint. It will be observed that the flap 50 folds between the end membered 22 and the flap 32 which is attached to it. It has an edge 56 which has a height and width to stand as tall as the end flap 22 at the cut 24. The shoulder 30 requires that it be recessed slightly and a notch 58 is formed in the profile of the flap 50. The notch 58 spans the shoulder 30. In effect, this doubles the thickness of material found at each side of the end flap 22. To this end, a circular hole 60 is formed in the flap 50 and a V-shaped notch 62 is also formed at the end edge. When the flap 50 is folded against the end flap 22 and before the flap 32 is folded over, the hole 60 coincides with the hole 38 in the end flap. The v-shaped notch 62 is coincident with the hole 40. As will be observed, a symmetrical flap is provided on the other side so that substantially all portions of the end flap 22 are doubly reinforced by the end flaps. This substantially increases the strength and body of the assembled box.

The notch 58 and the tab 56 are along the top edge of the end when assembled. The bottom edge includes a tab 64 which is received in a lock slot 66 formed in the bottom 12. This anchors the flap 50. The slot 66 is sufficiently long and wide to accommodate the tabs 64 on both of the flaps 50.

The top closure 18 includes a curved skirt 70 affixed at each end, the line between the two being defined by machine imprinted creases. The curved skirt 70 is adapted to lap over the shoulder 30 as shown in FIG. 1 of the drawings. This supports a lock tab 72 which points downwardly when the box is assembled. The lock tab 72 is cut at the corner 74 to permit it to insert easily. It has a general rectangular shape other than the corner which is cut away. The curved edge 76 can be any form or shape, but it is not structually helpful to square up the curved edge 76. The lock tab 72 inserts from above into the cut at the half thumb hole 42 as will be described.

The description to this juncture sets forth the construction of the blank which forms the carton 10. If convenient, the blank can be cut and shipped in the unfolded shape of FIG. 2. Indeed, hundreds can be stacked on a pallet for shipping. The carton 10 can be assembled quickly and easily. The mode of assembly requires the following steps. Both of the ends 22 are folded up. The sides 14 and 16 are folded up, also. The flap 50 appended to each side is then folded to the inside, positioned approximately parallel to the end wall 22, and is held in that position by the tab 64 which extends into and locks in the lock slot 66. At this juncture, the height and width of the box has been defined. However, the flaps 18, 20 and 32 extend above the level of the completed box. The flap 32 is folded towards the interior of the box, or is doubled back against the flap 22. When this is done, it captures the flap 50. The flap 50 is aligned with the holes 38 and 40. When the flap is caught in the requisite position, the apparatus is then aligned and locked by positioning the tab 46 in the slot 48. This is done at both ends. This then assembles both sides 14 and 16 to the duplicate ends of the equipment.

At this juncture, the box is fully open at the top. In other words, the lid portions 18 and 20 have not yet been closed over. The mouth or the opening of the box is equal in surface area to the bottom. In this partially assembled state, the box is then filled with produce. When the box has been filled, it is easily closed over. It is sealed or closed by bending the closures 18 and 20 to a horizontal posture, substantially as shown in FIG. 1. As the lid portions 18 and 20 are folded over, the curved skirt at each end is folded down. The lock tab 72 is moved arcuately toward the L-shaped slot 44. The tab 72 is jammed into the slot which positions it on the interior of the end member 22. It slides through the L-shaped cut 44 and is sandwiched, so to speak, between the end portion 22 and the flap 50 which is caught on the inside. This provides more than adequate friction to pinch the lock tab 72 and hold it in position. This assembly procedure is applied to all four corners of the rectangular box to complete its assembly. The box can then be easily handled and will safely protect the produce in it.

The box can be readily opened and reused by subsequent re-closure. The box is very durable and is able to be used several times. The lock tab 72 can be inserted into the L-shaped cut 44 many times during opening and closing.

It will be understood that the box can be constructed with different dimensions. The dimensions generally speaking are limited by the weight of the produce in the box and the depth of packing. For fragile produce such as tomatoes, there is a practical limit on how tall the box will be to avoid damaging the bottommost layers of tomatoes. On the other side of the coin, the box is generally not limited in and of its own construction. The box is preferably formed out of heavier gauge cardboard although single ply pasteboard can be used.

It is noteworthy that the lid portions 18 and 20 leave a central gap. It is usually desirable to ventilate produce. Ripening produce evolves gases which accelerate the ripening process. Thus, the box is open to vent to atmosphere the gases given off by the ripening fruit or produce.

All of the foregoing is directed to the preferred embodiment, but the scope of the present invention is determined by the claims which follow.

I claim:

1. A carton for holding produce which is comprised of:

(a) a sheet of cardboard of an appropriate gauge of thickness, the sheet folding into a bottom portion;

(b) an end portion which stands upright relative to said bottom;

(c) an attached side portion which is perpendicular to the end portion and to the bottom portion;

(d) a lid portion appended to the side portion which folds over and covers the top of the box when assembled;

(e) a lock tab affixed to a protruding skirt portion on said lid portion which inserts into an appropriately positioned locking slot cut in the end portion and wherein the lock tab extends towards the interior of the box upon insertion;

(f) said end portion further includes a shoulder constructed of multiple layers of the cardboard;

(g) wherein said end portion includes first and second parallel end portions which fold together into a double layer and which clamp between them a folded flap attached to the side portion to secure said side portion in position, and further including a shaped top edge on said end portion and conforming top edge on said folded flap;

(h) wherein said folded flap has a bottom edge located against the bottom of the carton;

(i) a locking slot in said bottom located to receive a protruding tab on said folding flap along the bottom edge thereof;

(j) a cut and scored fold line between the first and second parallel end portions which forms a webbing across the top edge of said shoulder;

(k) wherein said webbing defines a spacing between said first and second end portions to receive said folded flap between them as a means of capturing and holding them in relative position;

(l) holes means formed in said parallel end portion and said folded flap which align to define an opening for lifting of the carton;

(m) wherein said locking slot is an L-shaped cut into the exposed parallel end portion and said lock tab inserts therethrough and is frictionally grasped by said folded flap on insertion; and (n) wherein said L-shaped slot incorporates a top edge which is horizontal and which defines the bottom edge of a semicircular hole formed into said end portion, and said lock tab is formed into a tapered leading edge for ease of insertion.

2. The apparatus of claim 1 wherein said lock tab includes parallel side edges defining a width less than the length of the top edge of said L-shaped slot.

3. The apparatus of claim 2 wherein said L-shaped slot is comprised of two perpendicular cuts.

* * * * *